United States Patent [19]

Flinchum et al.

[11] 4,444,814

[45] Apr. 24, 1984

[54] FINISHING METHOD AND MEANS FOR CONVENTIONAL HOT-DIP COATING OF A FERROUS BASE METAL STRIP WITH A MOLTEN COATING METAL USING CONVENTIONAL FINISHING ROLLS

[75] Inventors: Charles Flinchum, Hamilton; Alan F. Gibson, Middletown, both of Ohio; Wayne G. Conley, Russell; Gayle P. Fields, Ashland, both of Ky.

[73] Assignee: Armco Inc., Middletown, Ohio

[21] Appl. No.: 387,375

[22] Filed: Jun. 11, 1982

[51] Int. Cl.[3] ..... B05C 3/12

[52] U.S. Cl. ..... 427/378; 427/432; 427/433; 427/434.4; 118/65; 118/68; 118/419

[58] Field of Search ..... 118/424, 115, 114, 117, 118/50, 419, 68, 65, 67; 427/432, 434.4, 436, 377, 378, 433, 419; 34/242

[56] References Cited

U.S. PATENT DOCUMENTS

| | | | |
|---|---|---|---|
| 1,143,922 | 6/1915 | Skemp et al. | 427/432 |
| 2,197,622 | 4/1940 | Sendzimir | 91/70.2 |
| 2,906,018 | 9/1959 | Baker | 118/424 X |
| 2,926,103 | 2/1960 | Brick | 118/114 X |
| 3,828,723 | 8/1974 | Herman | 118/65 X |
| 4,333,417 | 6/1982 | Camp et al. | 118/405 X |

*Primary Examiner*—John P. McIntosh

*Attorney, Agent, or Firm*—Frost & Jacobs

[57] ABSTRACT

A finishing method and apparatus for use in conventional hot-dip coating of the type wherein a ferrous base metal strip, having been appropriately pretreated so as to be at or near the proper coating temperature and so as to have its surfaces free of oxides, is cause to pass beneath the surface of a bath of molten coating metal, exiting the bath between conventional finishing rolls. The method comprises the steps of providing an enclosure which overlies at least the coating metal meniscus areas created between the finishing rolls and the strip, and maintaining within the enclosure an inert or non-oxidizing atmosphere to shroud the meniscus areas. The apparatus comprises the above mentioned enclosure with an appropriate system to provide and maintain the inert or non-oxidizing atmosphere therein.

25 Claims, 10 Drawing Figures

FINISHING METHOD AND MEANS FOR CONVENTIONAL HOT-DIP COATING OF A FERROUS BASE METAL STRIP WITH A MOLTEN COATING METAL USING CONVENTIONAL FINISHING ROLLS

TECHNICAL FIELD

The invention relates to a finishing method and apparatus for conventional hot-dip coating of a ferrous base metal strip with a molten coating metal utilizing conventional finishing rolls, and more particularly to a method and apparatus whereby an enclosure is provided about the coated strip as it exits the finishing rolls to maintain an inert or non-oxidizing atmosphere about the coating metal meniscus areas created by the finishing rolls on each side of the strip.

BACKGROUND ART

The method and apparatus of the present invention are applicable to the hot-dip coating of a ferrous base metal strip with zinc, zinc alloys, aluminum, aluminum alloys, terne and lead. While not intended to be so limited, for purposes of an exemplary showing, the method and apparatus of the present invention will be described as applied to galvanizing and aluminum coating.

The utilization of an inert or non-oxidizing atmosphere in association with the finishing step of a hot-dip coating process is not new in and of itself. For example, U.S. Pat. Nos. 4,107,357 and 4,114,563 and German Patent No. 2,656,524 are exemplary of patents teaching methods for coating one side only of a ferrous base metal strip. In the practice of these processes, the coated strip (after contact with the coating bath) is maintained in a protective, non-oxidizing atmosphere and is jet finished with nitrogen or non-oxidizing gas. The primary purpose of these steps is to prevent oxidation of that side of the ferrous base metal strip not coated.

U.S. Pat. Nos. 3,505,042 and 3,505,043 teach a method of hot-dip coating a ferrous base metal strip with a zinc-magnesium-aluminum coating. The strip is rapidly cooled by a non-oxidizing or reducing atmosphere until the coating solidifies to prevent or minimize oxidation of the magnesium in the coating.

U.S. Pat. No. 4,330,574 teaches a method of finishing a two-side coated ferrous base metal strip in a conventional continuous hot-dip coating line. The strip, exiting the coating metal bath, is maintained in an enclosure and subject to jet finishing within the enclosure. The jet finishing is accomplished with an inert or non-oxidizing gas and the jet finishing gas and the atmosphere within the enclosure are maintained at an oxygen level below about 1,000 ppm. By virtue of this, a number of finishing problems encountered with conventional jet finishing methods are markedly reduced or eliminated. The most significant aspect of this reference is the discovery that all coating control problems at the strip edges, generally encountered in jet finishing, are completely eliminated.

U.S. Pat. No. 2,992,941 teaches the provision of nozzles to either side of the strip in combination with finishing rolls. A blast of gas, such as air, is directed against the meniscus formed between the strip and the finishing rolls on both sides of the strip, the force of such blast being controlled to provide a back pressure to the pumping and dragging actions of the rolls and strip so that by increasing the force of the blast, these actions are impeded and the meniscus on each side of the strip is reduced.

At the present time, most high speed, conventional, hot-dip coating lines utilize jet finishing, rather than finishing rolls, since finishing rolls tend to limit permissible strip speeds. Nevertheless, finishing rolls are in common use in conventional hot-dip coating lines having a strip speed ranging from about 20 to about 150 feet per minute. While not necessarily so limited, many such lines today are used to coat heavier gauge ferrous base metal strips having a gauge or thickness of from about 0.060 inches to about 0.180 inches.

The present invention is based upon the discovery that a number of advantages are obtained in a conventional hot-dip metallic coating line utilizing traditional finishing rolls, when an enclosure is located about the coated ferrous base metal strip as it exits the finishing rolls. Within the enclosure, an inert or non-oxidizing atmosphere is provided to shroud the meniscus areas created by the finishing rolls. These advantages comprise an appearance improvement in the coating from elimination of oxide-related defects, a consistently uniform coating distribution and surface, reduced equipment wear, a reduced requirement for operator attention, an increased operating capacity by permitting higher line speeds without exceeding maximum coating weight specifications, and an improved response to subsequent surface treatment such as a spangle minimization treatment. These advantages will be further described and specified hereinafter.

DISCLOSURE OF THE INVENTION

According to the invention, there is provided an improved finishing method and apparatus for conventional continous hot-dip coating lines producing a two-side coated product and utilizing conventional finishing rolls. In the use of such a conventional hot-dip coating line, the ferrous base metal strip, having been appropriately pretreated so as to be at or near the proper coating temperature and so as to have its surfaces free of oxides, is caused to pass beneath the surface of the bath of molten coating metal, exiting the bath between conventional finishing rolls.

In accordance with the method of the present invention, the coated strip, as it leaves the finishing rolls, is surrounded by an enclosure. An inert or non-oxidizing atmosphere is introduced within the enclosure and is directed toward the molten metal meniscus formed to either side of the exiting strip to shroud these menisci. The non-oxidizing atmosphere is so maintained at the meniscus areas as to have an oxygen content of not more than about 2,000 ppm and preferably less, as will be described hereinafter. When the coating metal is zinc or zinc alloy, the strip exiting the enclosure may be subjected to a conventional spangle minimizing step, if desired.

For the best quality coating, the enclosure should fully enclose those parts of the finishing rolls extending above the bath surface and make a seal with the bath. From an operating standpoint, it is preferred that the enclosure be located above and partially overlie the finishing rolls at the coating metal meniscus areas created by the finishing rolls, leaving portions of the finishing rolls above the bath level exposed for reasons to be described hereinafter. The enclosure is preferably made of two halves which may be shifted toward and away from each other to adjust the width of the slot through which the coated strip exits the enclosure to accommodate for strip shape and different finishing roll diameters. Means are also provided for adjustment of this exiting slot to accommodate coated strips of various widths.

DETAILED DESCRIPTION OF THE INVENTION

As will be evident to one skilled in the art, prior to the practice of the present invention, the ferrous base metal strip will have to be pretreated. As used herein and in the claims with reference to the ferrous base metal strip, the terms "pretreated" and "pretreatment" refer to any appropriate technique, the result of which is such that, during the actual coating step wherein the ferrous base metal strip passes through the molten coating metal bath, it will be at or will achieve the proper coating temperature and its surfaces will be oxide-free. The strip temperature should be sufficiently high to prevent casting of the molten coating metal thereon. By the same token, the strip temperature must not be so high as to bring about excess coating metal-base metal alloying.

There are a number of pretreatment techniques well known in the art. One of the principal types of anneal-in-line, fluxless, preliminary treatments is the so-called Sendzimir process or oxidation-reduction practice disclosed in U.S. Pat. Nos. 2,110,893 and 2,197,622. Another anneal-in-line, fluxless, preliminary treatment in common use is the so-called Selas process or high intensity, direct fired furnace practice disclosed in U.S. Pat. No. 3,320,085. Other related pretreatment techniques are taught in U.S. Pat. Nos. Re. 29,726; 3,837,790; 4,123,291; 4,123,292; and 4,140,552. These prior art patents constitute non-limiting examples of fluxless, continuous coating processes to which the method of the present invention is applicable. When such conventional strip preparation techniques as are taught in the above mentioned prior art patents are used, it is necessary that the base metal strip be maintained in a protective atmosphere at least until it passes beneath the surface of the bath of molten coating metal. Such a protective atmosphere is not a requirement when flux or chemical strip preparation techniques of the type taught in U.S. Pat. Nos. 2,824,020 and 2,824,021 are employed.

From the above, it will be evident that the method and apparatus of the present invention is not limited to the use of any particular pretreatment technique on the ferrous base metal strip. In conventional continuous hot-dip coating, utilizing finishing rolls, it is usual to cause the two-side coated ferrous base metal strip to enter the coating pot bath, to pass about one or more pot rolls submerged within the bath, and to exit the bath into the ambient atmosphere in a substantially vertical path of travel, passing between a pair of finishing rolls partially submerged in the molten coating metal bath.

Figure 2:
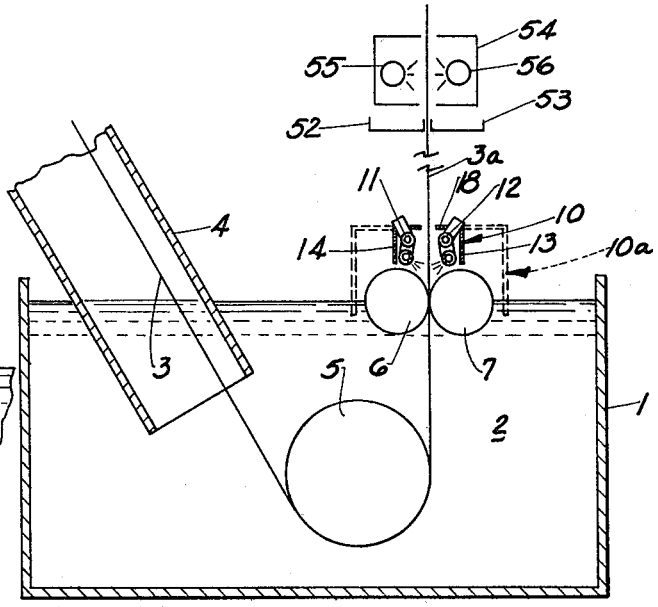
FIG. 2 is a fragmentary, semi-diagrammatic, cross-sectional view of the coating pot portion of a continuous coating line equipped to practice the present invention.

While not intended to be so limited, for purposes of an exemplary showing, FIG. 2 illustrates the coating end of a typical fluxless, continuous galvanizing line of the Sendzimir or Selas types. A coating pot is shown at 1 containing a bath 2 of zinc or zinc alloy. The ferrous base metal strip 3 is directed into the bath 2 through a snout 4 leading from the conventional pretreatment apparatus. It will be understood that the snout 4 will contain a non-oxidizing atmosphere to protect the as yet uncoated ferrous base metal strip.

Upon entry into the bath, the strip 3 passes about a submerged pot roll 5. When required, more than one pot roll may be provided. After passing about pot roll 5, the ferrous base metal strip moves in a substantially vertical path of travel and exits the bath 2 between a pair of partially submerged finishing rolls 6 and 7.

Figure 1:
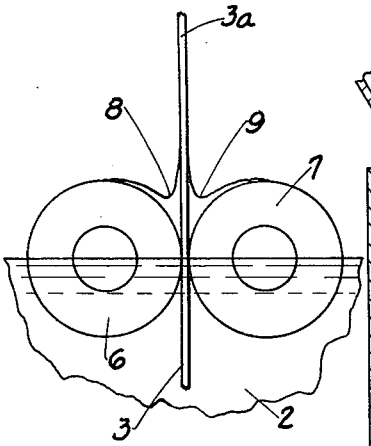
FIG. 1 is a fragmentary, diagrammatic view illustrating the molten coating metal bath, the finishing rolls, the ferrous base metal strip and the menisci formed by the finishing rolls to either side of the base metal strip.

FIG. 1 is a fragmentary diagrammatic view illustrating the bath 2, exit rolls 6 and 7, and the ferrous base metal strip 3. As the ferrous base metal strip 3 passes between finishing rolls 6 and 7 coating metal menisci 8 and 9 are formed to either side of the ferrous base metal strip. During the coating operation, a part of the molten metal at each meniscus 8 and 9 travels upwardly with the strip, producing the final coated strip 3*a*. Similarly, a part of the molten coating metal at each meniscus 8 and 9 is returned to the bath by the finishing rolls 6 and 7. The nature of each meniscus 8 and 9 is governed by the depth to which the rolls 6 and 7 extend into the bath 2. It is also dependent upon the nature of the grooves and groove spacing (not shown) on the finishing rolls 6 and 7. The amount of molten metal taken from the meniscus areas 8 and 9 and returned to the bath 2 by rolls 6 and 7 depends, in part at least, on the rotational speed of the rolls 6 and 7 relative to the strip speed.

According to the invention, an enclosure is provided. The enclosure is generally indicated in FIG. 2 at 10. It would be within the scope of the present invention to provide an enclosure which would completely enclose finishing rolls 6 and 7 and would extend into the bath 2 to make a seal therewith. Such an enclosure would yield optimum coating quality and is illustrated in FIG. 2 in broken lines at 10*a*. Such an enclosure, however, must anticipate the need for operator access for periodic roll dressing and the like. It has therefore been found both adequate and, from an operational standpoint, preferable to provide a smaller enclosure of the type shown at 10 which excludes parts of the bodies of finishing rolls 6 and 7 and their necks. Manifolds 11 and 12 are provided to either side of the ferrous base metal strip. These manifolds introduce into the enclosure 10 an inert or non-oxidizing gas, such as nitrogen. The inert or non-oxidizing gas is directed toward and shrouds the adjacent menisci 8 and 9 so as to provide a protective atmosphere thereabout having an oxygen content of not more than about 2,000 ppm, and preferably less (as will be described hereinafter). It is important to note that manifolds 11 and 12 are not jet finishing nozzles and that the inert or non-oxidizing gas introduced thereby is not used to finish the coating, i.e. to physically control the coating thickness, as in conventional jet finishing operations. Similarly, the manifolds are not used to create blasts as in U.S. Pat. No. 2,992,941, mentioned above. Furthermore, the coating on both sides of the coated strip 3*a* is still molten as it leaves enclosure 10.

Figure 3:
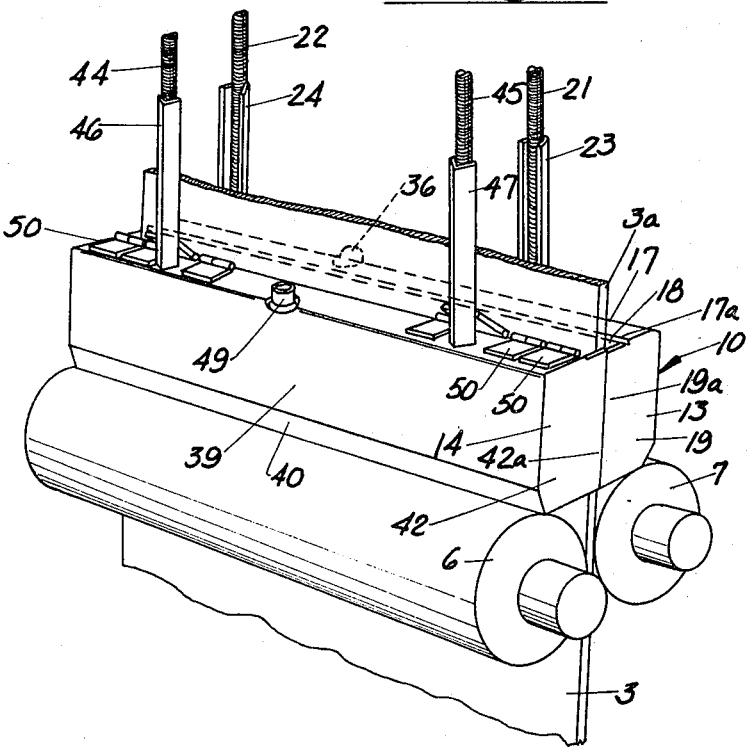
FIG. 3 is a fragmentary, prospective view illustrating the ferrous base metal strip, the finishing rolls, and the enclosure of the present invention.
Figure 4:
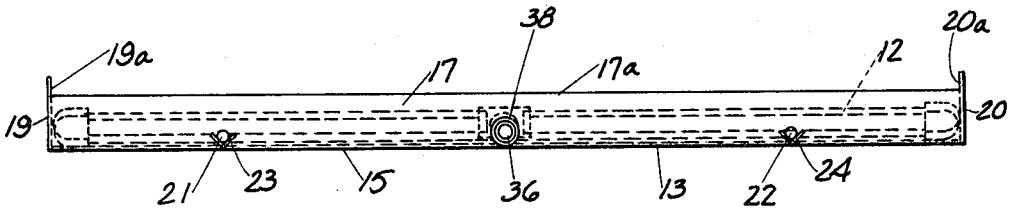
FIGS. 4 and 5 are respectively a plan and an elevational view of one-half of the enclosure of FIG. 3.
Figure 5:
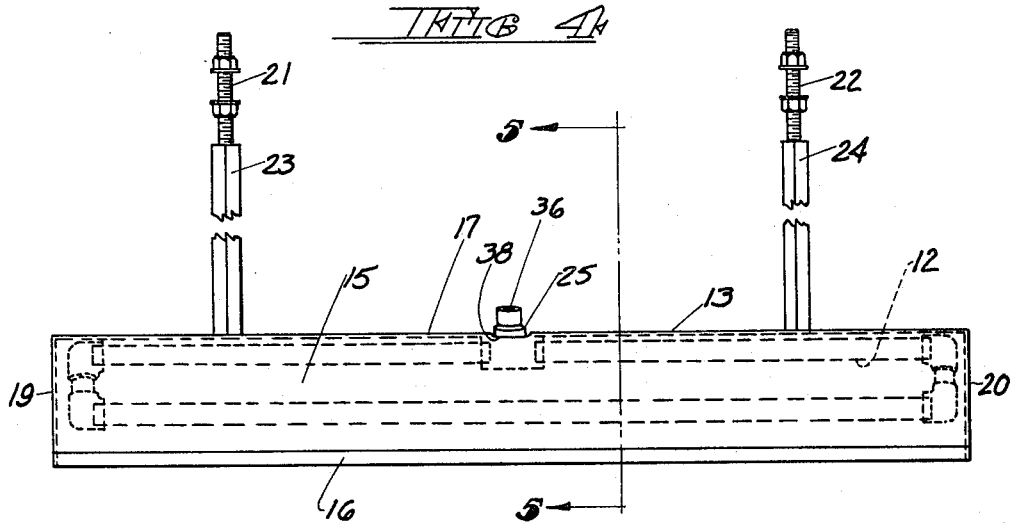
Figure 6:
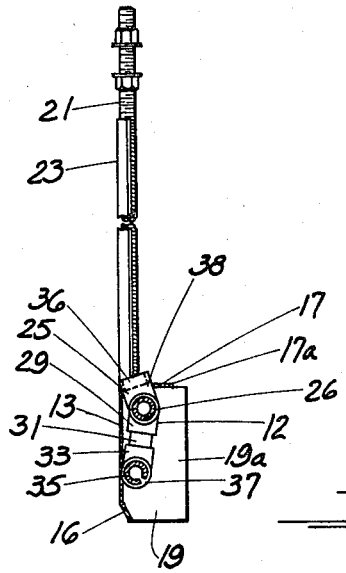
FIG. 6 is a cross-sectional view taken along section line 5—5 of FIG. 5.

As is most clearly seen in FIG. 3, the enclosure 10 is made up of two substantially identical halves 13 and 14. Enclosure half 13 is illustrated in FIGS. 4, 5 and 6. The enclosure half 13 comprises an elongated longitudinal wall 15, the bottom portion 16 of which is angled inwardly. Longitudinal wall 15 is surmounted by a coextensive top wall 17, the free edge 17*a* of which will partially define the slot 18 through which the coated strip 3*a* passes (see FIG. 3). To complete enclosure half 13, side walls 19 and 20 are provided. The side walls 19 and 20 are identical. It will be evident from FIGS. 4 and 6 that side walls 19 and 20 extend beyond the free edge 17*a* of top wall 17. Those portions of side walls 19 and 20 which extend beyond top wall edge 17*a* constitute flanges 19*a* and 20*a*, the purpose of which will be evident hereinafter.

To support enclosure half 13 in proper position over finishing roll 7, a pair of threaded rods are affixed to top wall 17 in parallel spaced relationship. Threaded rods 21 and 22 may be attached to top wall 17 by welding, the use of appropriate fastening means, or the like. To protect threaded rods 21 and 22, angle irons 23 and 24 may also be affixed to top wall 13.

Figure 7:
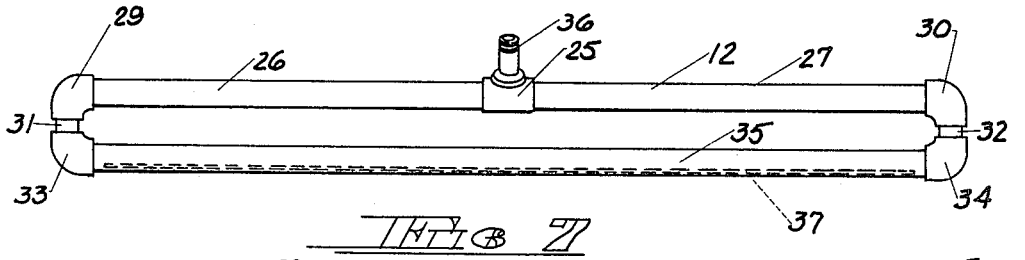
FIG. 7 is an elevational view of the non-oxidizing gas manifold illustrated in FIGS. 4—6.

Manifold 12 is located within enclosure half 13. Manifold 12 is illustrated in FIG. 7. The manifold 12 is made up of a T-fitting 25 by which pipe sections 26 and 27 are joined together. Pipe sections 26 and 27 terminate respectively in elbows 29 and 30. Elbows 29 and 30, in turn, are connected by short pipe sections 31 and 32 to elbows 33 and 34. The elbows 33 and 34 are joined together by an elongated pipe section 35. It will be evident from FIG. 7 that this structure comprises an elongated, flattened tubular loop. The T-fitting 25 has an inlet for inert or non-oxidizing gas such as nitrogen, as at 36. The elongated pipe section 35 has a slot 37 formed therein and extending substantially the length thereof. The slot 37 (see also FIG. 6) is so located as to direct the inert or non-oxidizing gas toward the adjacent molten metal meniscus. An opening 38 is provided in top wall 17 of enclosure half 13 to accommodate the inlet 36 of T-fitting 25.

Figure 8:
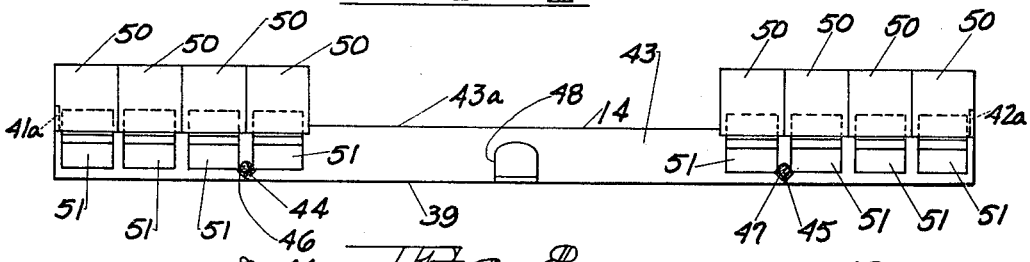
FIGS. 8 and 9 are respectively a plan view and an elevational view of the other half of the enclosure of the present invention.
Figure 9:
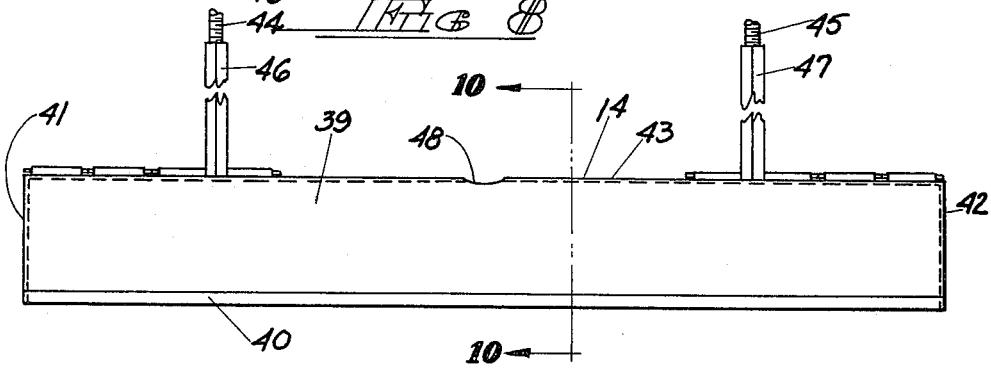
Figure 10:
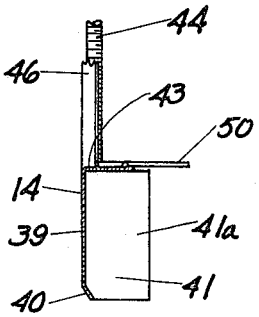
FIG. 10 is a cross sectional view taken along section line 10—10 of FIG. 9.

FIGS. 8–10 illustrate the half 14 of enclosure 10. The half 14 is substantially identical to the half 13. Thus, the half 14 comprises an elongated longitudinal wall 39 having an in-turned lower portion 40, end walls 41 and 42, and a top wall 43. The enclosure half 14 is provided with threaded rods 44 and 45, identical to threaded rods 21 and 22 and angle irons 46 and 47, identical to angle irons 23 and 24. The enclosure half 14 has an opening 48 in its top wall 43 to accommodate the outlet 49 of manifold 11. The manifold 11 is identical manifold 12 of FIGS. 6 and 7. As in the case of enclosure half 13, the leading edge 43*a* of top wall 43 in part defines the slot 18 (FIG. 3) through which the coated ferrous base metal strip 3*a* exits the enclosure 10. Again, side walls 41 and 42 are of greater width than top wall 43 so that their free vertical edges form flanges 41*a* and 42*a*, equivalent to flanges 19*a* and 20*a* of enclosure half 13. The purpose of these flange portions will be evident hereinafter.

Enclosure half 14 differs from enclosure half 13 only in that a plurality of identical, adjacent, flaps 50 are mounted on top wall 43 by means of hinges 51. These flaps 50 are swingable between a retracted position in which they overlie top wall 43 as shown in FIG. 3 and an extended position in which they extend forwardly of top wall edge 43*a*, as shown in FIGS. 8 and 10. The purpose of flaps 50 will be described hereinafter.

The enclosure halves 13 and 14 may be made of sheet metal or the like. FIG. 3 illustrates the enclosure halves 13 and 14 in assembled position to form enclosure 10 over finishing rolls 6 and 7. The halves 13 and 14 are suspended by threaded rods 21–22 and 44–45, respectively. The threaded rods, in turn, may be affixed to any appropriate support means (not shown) as, for example, portions of the support means for finishing rolls 6 and 7. The fact that rods 21–22 and 44–45 are threaded permits adequate height adjustment above finishing rolls 6 and 7 which, themselves, may be adjusted with respect to the depth to which they extend into molten coating metal bath 2. It is necessary that threaded rods 21–22 and 44–45 be so affixed to their support means that enclosure halves 13 and 14 can be moved toward and away from each other. This can be accomplished, for example, by having the threaded rods extend through elongated slots in their support means. Enabling enclosure halves 13 and 14 to be shifted toward and away from each other allows for adjustment of the width of the slot 18 through which the coated strip 3*a* exits the enclosure. This, in turn, permits adjustment for transverse strip shape. This also permits adjustment for finishing rolls of various diameters. If the slot 18 must have its maximum width, the enclosure half side wall flange portions 19*a*–42*a* and 20*a*–41*a* can be abutted as shown in FIG. 3 to form closed ends for enclosure 10. If excellent strip shape is achieved and maintained, and if roll diameters permit, slot 18 can be narrowed simply by moving enclosure halves 13 and 14 toward each other and overlapping the enclosure half end wall flange portions 19*a*–42*a* and 20*a*–41*a*.

Furthermore, in FIG. 3 the ferrous base metal strip 3 is illustrated as having a width requiring substantially the full length of slot 18. As a result, all of flaps 50 are in their retracted position overlying top wall 43. If the strip 3 had been narrower, an appropriate number of flaps 50 at either end of enclosure 10 can be flipped to their extended position to close off unused end portions of slot 18. Finally, the enclosure halves 13 and 14 are located as close to finishing rolls 6 and 7 as is practical, without interfering with that portion of the molten metal meniscus material being returned by the finishing rolls to the bath. As a result of this construction, a shrouded zone of protection, substantially restricted to the meniscus areas, is provided and the numbers and sizes of the openings in the chamber are minimized to discourage oxygen diffusion and to reduce the required purging rate of the inert or non-oxidizing gas entering the enclosure 10 by means of manifolds 11 and 12. It will be understood by one skilled in the art that the inlet 49 of manifold 11 and the inlet 36 of manifold 12 will both be connected to an appropriate source of inert of non-oxidizing gas, preferably by means of flexible conduits enabling positioning adjustment of the enclosure halves 13 and 14.

The apparatus of the present invention having been described, the process may be set forth as follows, with reference to FIG. 2. As indicated above, the ferrous base metal strip will be appropriately pretreated so that when it passes through the molten metal bath 2, it will be at or will achieve the proper coating temperature and its surface will be oxide-free. When a fluxless preliminary treatment such as the above noted Sendzimir or the above noted Selas process is used, the strip 3 will be maintained in a protective, non-oxidizing atmosphere and will be introduced into the bath 2 through the snout 4. Passing about the submerged pot roll 5, the strip is directed in a substantially vertical path of travel and exits bath 2, passing between finishing rolls 6 and 7. Having passed between rolls 6 and 7, the strip enters enclosure 10 and exits the enclosure through slot 18. Thereafter, the coated strip 3*a* may be coiled or subjected to additional treatment steps.

It has been found that reducing or eliminating oxygen from the enclosure 10 results in a number of advantages. First of all, there is a marked improvement resulting from the elimination of oxide-related defects. The process eliminates coating sags, oxide feathers and dross defects. Furthermore, a consistently uniform coating distribution and surface is achieved without heavy edges and the like.

The inert or non-oxidizing gas, on each side of the strip, is directed toward the menisci 8 and 9 at the point on each side of the strip where a portion of the molten coating metal coats the strip and a portion of the molten coating metal returns to the bath via finishing rolls 6 and 7. The reason for the consistently uniform coating distribution and surface is the elimination or minimization of oxide skin effects at the point of coating. It has been determined that in the presence of the inert or non-oxidizing gas, the menisci are more uniform and less wavy. While the inert or non-oxidizing gas is maintained at a positive pressure within enclosure 10, data shows that the inert or non-oxidizing gas is not acting as a jet finishing medium, as in the above mentioned U.S. Pat. No. 4,330,574. The molten coating metal does act as if it has a more uniform viscosity.

Depending upon its ultimate use, it may be desirable to subject the coated ferrous base metal strip to a spangle minimizing step. U.S. Pat. Nos. 3,322,558; 3,379,557; and 3,756,844 teach exemplary spangle minimization techniques. Any of the above mentioned minimizing processes can be used. While not intended to be limiting, a preferred minimizing procedure is taught in the above mentioned U.S. Pat. No. 3,379,557, the teachings of which are incorporated herein by reference. Briefly, a water solution of an organic salt is mixed with steam and sprayed against the freshly coated strip at a point just below that position where normal coating solidification would occur. It will be understood that the coating is still molten when the strip exits enclosure 10. The inorganic salt is selected from the class consisting of inorganic salts which decompose in the range of 175° F. to 550° F. (80° C. to 90° C.) and those salts which will hydrolize when added to water to form inorganic salts capable of decomposing in the above stated temperature range. The water solution is applied to the coated strip in a band extending transversely of the direction of strip travel, the band having such a width that the coating metal is molten as it enters the band and solid as it leaves the band. The inorganic salt solution of the type described provides a multitude of solidification nuclei to the coating when the coating is at a temperature very close to the solidification point (or freezing point) of the coating metal. This results in introducing a multitude of closely spaced, relatively minute spangles which are sub-microscopic, or so nearly so as to be just barely visible to the naked eye.

This procedure is diagrammatically illustrated in FIG. 2. The two-side coated ferrous base metal strip 3*a* exits enclosure 10 and is caused to pass between a pair of tray-like structures 52 and 53 and through an enclosure 54 containing spray nozzles 55 and 56 for the minimizing inorganic salt solution. Trays 52 and 53 serve to catch the majority of the overspray condensate.

The practice of the present invention has been found to result in an improved response to a minimizing process. This is true because the finishing method of the present invention provides a more uniform coating across the width of the ferrous base metal strip. This results in a more uniform cooling of the coated strip edge-to-edge and thus a more uniform thermal profile. Finally, there is less surface oxide to interfere with nucleation. The more uniform cooling and the reduced amount of surface oxide produced by the finishing method of the present invention gives more latitude to the placement of the minimizing nozzles 55 and 56 and reduces the amount of spray required. With less spray, there is less hazard of coating damage from pitting. A smaller, more uniform spangle size is consistently achieved across the strip width. In instances where spangle is of no concern or is desired, and in instances where a coating metal other than zinc or zinc alloy is used, a minimizing step need not be practiced.

The practice of the present invention results in reduced equipment wear and reduced requirement for operator attention. Less dross fines are created and less top skimming and roll dressing are required of the operator. Nevertheless, since the enclosure 10 overlies primarily the meniscus areas and since its lower edges angle inwardly as at 16 and 40, large segments of finishing rolls 6 and 7 are exposed so as to permit roll dressing by the operator without difficulty.

As indicated above, the atmosphere introduced into chamber 10 by means of manifolds 11 and 12 is an inert or non-oxidizing atmosphere. For reasons of economy, nitrogen is preferred. The atmosphere is maintained within enclosure 10 at a positive pressure. For best results, the atmosphere within the chamber 10 should have an oxygen content of less than about 100 ppm. As the oxygen content of enclosure 10 increases, the benefits of the present invention diminish. While there is no absolute upper limit to the permissible oxygen content, and while discernable improvements are still noticeable at an oxygen content of about 2,000 ppm, the benefits achieved would probably not justify the practice of the present invention at an oxygen content much above about 2,000 ppm, particularly for zinc or zinc alloys. It has been found that a zinc or zinc alloy coating metal is more sensitive to oxygen content within enclosure 10 than is an aluminum or an aluminum alloy coating metal. Thus, the coating quality of an aluminum coating at an oxygen content within enclosure 10 of about 700 ppm has been found to be comparable to that of a zinc coating with an oxygen content within enclosure 10 of less than 100 ppm. While 2,000 ppm is still a preferred maximum for aluminum and aluminum alloy coating, levels up to 5,000 ppm oxygen still result in an improved coating surface.

Finally, the practice of the present invention also enables increased operating capacity by permitting higher line speeds without exceeding maximum coating weight specifications. This is true because, in the practice of the present invention, not only is greater coating uniformity and better coating surface achieved, but also the coatings are of reduced thickness. The reasons for this are not fully appreciated since the non-oxidizing or inert gas is not used as in a jet finishing process, and in the use of finishing rolls, the coating weight is usually determined by such factors as the bath temperature, the nature and spacing of the roll grooves, the depth of the rolls in the bath, and the ratio of the roll speed to the strip speed. While not wishing to be limited by theory, it is believed possible that the inert or non-oxidizing atmosphere prevents or minimizes oxide formation. The coating metal does appear to behave as if it has a more uniform viscosity.

To demonstrate this feature of the invention, coating runs were made in the laboratory coating a 0.015 inch thick ferrous base metal strip with pure aluminum. All runs were made at a strip speed of 30 feet per minute. Three runs were made without an enclosure, the coated ferrous base metal strip exiting the finishing rolls into the ambient atmosphere. In all three of these runs, the coated ferrous base metal strip had an aluminum coating of 0.4 ounce per square foot per side. Another run was made in an identical manner with the exception that nitrogen was present at the area of the menisci (no enclosure being provided). In this run, a coating weight of 0.4 ounce per square foot per side was again achieved. Three more runs were made, again at a strip speed of 30 feet per minute. In each of these runs, an enclosure was provided and the oxygen content within the enclosure was maintained at 2,000 ppm, 700 ppm and 500 ppm, respectively. In all three instances, a coating weight of 0.31 ounce per square foot per side was achieved. Yet another run was made at a strip speed of 60 feet per minute utilizing an enclosure and maintaining the oxygen count therein at about 500 ppm. In this instance, a coating weight of 0.37 ounce per square foot per side was achieved. Comparing the two runs utilizing an enclosure and having an oxygen content therein of about 500 ppm, one run at a strip speed of 30 feet per minute and the other run at a strip speed of 60 feet per minute, it will be noted that doubling the running speed increased the coating weight by only 0.06 ounce per square foot per side. All of the runs employing an enclosure utilized nitrogen as a non-oxidizing atmosphere. All of these runs demonstrated a better coating distribution with a smoother finish and no heavy edges, oxide feathers, coating sags, dross defects, or the like. These surface characteristics of the coating improved as the oxygen content within the enclosure decreased.

Two laboratory coating runs were made using a 0.015 inch thick ferrous base metal strip and a substantially pure zinc coating bath. Both runs were performed at a strip speed of 30 feet per minute. The first run was without an enclosure and in the ambient atmosphere. This run produced a coating weight of 0.79 ounce per square foot per side. The second run, utilizing an enclosure and maintaining the oxygen content therein at a level of about 500 ppm produced a coating weight of 0.43 ounce per square foot per side. Two more runs were made with the same molten zinc coating metal and the same ferrous base metal strip. In these runs, the strip speed was increased to 50 feet per minute. One run conducted in ambient air produced a coating weight of 0.80 ounce per square foot per side while the other run utilizing an enclosure and maintaining the oxygen level therein at about 500 ppm produced a coating weight of 0.74 ounce per square foot per side. It will be noted that the zinc demonstrated a coating weight reduction when applied in accordance with the present invention, although the reduction was more pronounced at the lower speed of 30 feet per minute than at the higher speed of 50 feet per minute.

In general, for aluminum coating it has been found that if an enclosure is provided in accordance with the present invention utilizing a nitrogen atmosphere and maintaining the oxygen content therein at or below about 2,000 ppm, the resulting coating weight is reduced about 25% as compared to the same procedure run in the ambient atmosphere without an enclosure. Similarly, maintaining the oxygen content within the enclosure at about 500 ppm and doubling the coating speed from 30 feet to about 60 feet per minute increases the coating weight only about 20%. Similar trends are demonstrated in galvanizing procedures, although tolerance for oxygen contamination is somewhat lower with respect to a zinc coating.

Modifications may be made in the invention without departing from the spirit of it.

What is claimed is:

1. A finishing process for conventional continuous hot-dip, two-side coating of a ferrous base metal strip with a molten coating metal of the type wherein said ferrous base metal strip is caused to enter a bath of said molten coating metal contained in a coating pot, said ferrous base metal strip having been treated to bring it to a coating temperature sufficiently high to prevent casting of said coating metal thereon and low enough to prevent excess coating metal—base metal alloying and to render the surfaces of said strip clean and free of oxide as it passes through said molten coating metal bath, said ferrous base metal strip exiting said bath between a pair of conventional finishing rolls partially submerged in said bath and forming a molten coating metal meniscus to either side of said strip as it passes from between said finishing rolls, a portion of said coating metal at said menisci traveling upwardly with said strip and a portion of said coating metal at said menisci being returned to said bath by said finishing rolls, said finishing process comprising the steps of providing an enclosure which overlies at least said meniscus areas of said finishing rolls and said strip and having an exit slot for said strip, providing a pair of manifolds located to each side of said strip to introduce a non-oxidizing atmosphere into said enclosure and to direct said atmosphere toward said menisci where said portion of said coating metal travels upwardly with said strip and said portion of said coating metal returns to said bath, to shroud said menisci therewith, maintaining said atmosphere at a positive pressure within said enclosure, and withdrawing said strip from said enclosure.

2. The process claimed in claim 1 including the steps of providing said enclosure in two halves extending longitudinally of said finishing rolls and locating said halves immediately above said rolls so as to overlie said menisci and so as to permit dressing of said rolls, providing each enclosure half with a longitudinal wall, end walls and a top wall, with the free edges of said top walls defining said exit slot for said strip, and with said side walls of each of said enclosure halves extending beyond said free edge of its top wall, abutting or lapping said side walls to adjust the width of said exit slot, providing flap means on at least one of said enclosure half top walls and closing therewith end portions of said exit slot when not required by the width of said strip, and providing one of said manifolds within each of said enclosure halves.

3. The process claimed in claim 2 wherein said molten coating metal is chosen from the class consisting of zinc, zinc alloys, aluminum, aluminum alloys, terne and lead.

4. The process claimed in claim 2 wherein coating metal is chosen from the class consisting of zinc and zinc alloys, and including the step of maintaining said atmosphere within said enclosure at an oxygen level of not more than about 2,000 ppm.

5. The process claimed in claim 2 wherein said coating metal is chosen from the class consisting of aluminum and aluminum alloys and including the step of maintaining said atmosphere within said enclosure at an oxygen level of not more than about 5,000 ppm.

6. The process claimed in claim 2 wherein said non-oxidizing atmosphere within said enclosure comprises nitrogen.

7. The process claimed in claim 2 wherein said non-oxidizing atmosphere within said enclosure comprises an inert gas.

8. The process claimad in claim 2 including the step of maintaining said non-oxidizing atmosphere within said enclosure at an oxygen level of less than about 100 ppm.

9. The process claimed in claim 1 including the step of adjusting the length and width of said exit slot according to the width and transverse shape of said ferrous base metal strip.

10. The process claimed in claim 1 wherein said molten coating metal is chosen from the class consisting of zinc, zinc alloys, aluminum, aluminum alloys, terne and lead.

11. The process claimed in claim 1 wherein said coating metal is chosen from the class consisting of zinc and zinc alloys, and including the step of maintaining said atmosphere within said enclosure at an oxygen level of not more than about 2,000 ppm.

12. The process claimed in claim 1 wherein said coating metal is chosen from the class consisting of aluminum and aluminum alloys and including the step of maintaining said atmosphere within said enclosure at an oxygen level of not more than about 5,000 ppm.

13. The process claimed in claim 1 wherein said non-oxidizing atmosphere within said enclosure comprises nitrogen.

14. The process claimed in claim 1 wherein said non-oxidizing atmosphere within said enclosure comprises an inert gas.

15. The process claimed in claim 1 including the step of maintaining said non-oxidizing atmosphere within said enclosure at an oxygen level of less than about 100 ppm.

16. The process claimed in claim 1 including the step of subjecting said two-side coated strip to a spangle minimizing treatment after said strip exits said enclosure.

17. A finishing process for conventional continuous hot-dip, two-side coating of a ferrous base metal strip with a molten coating metal of the type wherein said ferrous base metal strip is caused to enter a bath of said molten coating metal contained in a coating pot, said ferrous base metal strip having been treated to bring it to a coating temperature sufficiently high to prevent casting of said coating metal thereon and low enough to prevent excess coating metal—base metal alloying and to render the surfaces of said strip clean and free of oxide as it passes through said molten coating metal bath, said ferrous base metal strip exiting said bath between a pair of conventional finishing rolls partially submerged in said bath and forming a molten coating metal meniscus to either side of said strip as it passes from between said finishing rolls, a portion of said coating metal at said menisci traveling upwardly with said strip and a portion of said coating metal at said menisci being returned to said bath by said finishing rolls, said finishing process comprising the steps of directing a non-oxidizing atmosphere towards said menisci where said portion of said coating metal travels upwardly with said strip and said portion of said coating metal returns to said bath, and shrouding said menisci with said non-oxidizing atmosphere to provide a uniform smooth coating free of oxide-related defects.

18. Finishing apparatus for use with a conventional coating line for the hot-dip, two-side coating of a ferrous base metal strip with a molten coating metal, said coating line being of the type having a coating pot, a bath of molten coating metal within said coating pot, means to conduct said ferrous base metal strip through said molten coating metal bath, strip preparation means to bring said ferrous base metal strip to a coating temperature sufficiently high to prevent casting of said coating metal thereon and low enough to prevent excess coating metal-base metal alloying and to render the surfaces of said strip clean and free of oxide as it passes through said molten coating metal bath, at least one pot roll beneath the surface of said bath about which said strip passes and by which said strip is directed upwardly in said bath in a substantially vertical path of travel, and a pair of conventional finishing rolls partially submerged in said bath and forming a molten coating metal meniscus to either side of said strip as it exits said bath and from between said finishing rolls, a portion of said coating metal at said menisci traveling upwardly with said strip and a portion of said coating metal at said menisci being returned to said bath by said finishing rolls, said finishing apparatus comprising an enclosure overlying at least said menisci, said enclosure having an exit slot for said strip, and a pair of manifolds located to each side of said strip to maintain a non-oxidizing atmosphere at a positive pressure within said enclosure and to direct said atmosphere toward said menisci where said portion of said coating metal travels upwardly with said strip and said portion of said coating metal returns to said bath, and to shroud said menisci with said non-oxidizing atmosphere.

19. The structure claimed in claim 18 wherein said enclosure comprises two substantially identical halves in facing relationship and extending longitudinally of said finishing rolls, said halves being located immediately above said finishing rolls so as to enclose said menisci, each of said enclosure halves comprising a longitudinal wall, end walls and a top wall, the free longitudinal edge of said top walls defining said exit slot for said strip, said side walls of each of said enclosure halves extending beyond said free edge of its top wall and being abuttable or lapable with said side walls of the other enclosure half to adjust the width of said exit slot, a plurality of flaps hingedly mounted on at least one of said top walls to close end portions of said exit slot when not required by the width of said strip, one of said manifolds being located in each of said enclosure halves and extending longitudinally thereof, means to connect each of said manifolds to a source of said non-oxidizing gas, each of said manifolds having a longitudinally extending slot to introduce said non-oxidizing gas in said enclosure and to direct said non-oxidizing gas toward the adjacent one of said menisci, and adjustable support means to mount said enclosure halves immediately above said finishing rolls, to adjust the height of said enclosure, and to shift said enclosure halves toward and away from each other to adjust the width of said exit slot.

20. The structure claimed in claim 19 wherein said coating metal is chosen from the class consisting of zinc and zinc alloys, and including means to maintain said non-oxidizing gas within said enclosure at an oxygen level of not more than about 2,000 ppm.

21. The structure claimed in claim 19 wherein said coating metal is chosen from the class consisting of aluminum and aluminum alloy and including means to maintain said atmosphere within said enclosure at an oxygen level of not more than about 5,000 ppm.

22. The structure claimed in claim 19 including means to maintain said non-oxidizing gas within said enclosure at an oxygen level of less than about 100 ppm.

23. The structure claimed in claim 17 wherein said coating metal is chosen from the class consisting of zinc and zinc alloys, and including means to maintain said non-oxidizing gas within said enclosure at an oxygen level of not more than about 2,000 ppm.

24. The structure claimed in claim 18 wherein said coating metal is chosen from the class consisting of aluminum and aluminum alloy and including means to maintain said atmosphere within said enclosure at an oxygen level of not more than about 5,000 ppm.

25. The structure claimed in claim 18 including means to maintain said non-oxidizing gas within said enclosure at an oxygen level of less than about 100 ppm.

* * * * *